US007513539B2

(12) United States Patent
Phipps

(10) Patent No.: US 7,513,539 B2
(45) Date of Patent: Apr. 7, 2009

(54) LOCKING ASTRAGAL AND ASSOCIATED METHODS

(76) Inventor: Brian Phipps, 2125 SW. 6th Way, Miramar, FL (US) 33023

( * ) Notice: Subject to any disclaimer, the term of this patent is extended or adjusted under 35 U.S.C. 154(b) by 0 days.

(21) Appl. No.: 12/042,688

(22) Filed: Mar. 5, 2008

(65) Prior Publication Data

US 2008/0157544 A1 Jul. 3, 2008

Related U.S. Application Data

(63) Continuation-in-part of application No. 11/450,054, filed on Jun. 9, 2006.

(51) Int. Cl.
*E05C 9/16* (2006.01)
*E05C 1/06* (2006.01)

(52) U.S. Cl. ..... 292/36; 292/143; 292/DIG. 31

(58) Field of Classification Search ..... 292/32, 292/36, 41, 42, 138, DIG. 21, 40, 137, 139, 292/143, 145, 147, 150, 152, 153, 334, 335, 292/340, DIG. 15, DIG. 31, DIG. 49; 49/365–369, 49/395

See application file for complete search history.

(56) References Cited

U.S. PATENT DOCUMENTS

| | | | | | |
|---|---|---|---|---|---|
| 3,556,573 | A | * | 1/1971 | Miller | 292/143 |
| 3,680,901 | A | * | 8/1972 | Biebuyck | 292/36 |
| 4,058,332 | A | | 11/1977 | DiFazio | 292/147 |
| 4,428,153 | A | | 1/1984 | Klinger et al. | 49/366 |
| 4,429,493 | A | | 2/1984 | St. Aubin | 49/367 |
| 5,328,217 | A | | 7/1994 | Sanders | 292/341.19 |
| 5,350,207 | A | | 9/1994 | Sanders | 292/335 |
| 5,590,919 | A | | 1/1997 | Germano | 292/137 |
| 5,675,947 | A | | 10/1997 | Yane | 52/207 |
| H1766 | H | | 1/1999 | Horton | 70/131 |
| 5,857,291 | A | | 1/1999 | Headrick | 49/368 |
| D424,214 | S | | 5/2000 | Siudzinski | D25/122 |
| D438,445 | S | | 3/2001 | Monts de Oca | D8/331 |
| 6,453,616 | B1 | | 9/2002 | Wright | 49/365 |
| 6,457,751 | B1 | | 10/2002 | Hartman | 292/137 |
| 6,491,326 | B1 | | 12/2002 | Massey et al. | 292/162 |
| 6,725,602 | B1 | | 4/2004 | McWilliams | 49/31 |
| 6,905,152 | B1 | | 6/2005 | Hudson | 292/143 |
| 2005/0120631 | A1 | | 6/2005 | Sanders | 49/367 |
| 2005/0127692 | A1 | | 6/2005 | Sanders | 292/340 |
| 2006/0150517 | A1 | | 7/2006 | Meeks et al. | 49/368 |

* cited by examiner

*Primary Examiner*—Patricia L Engle
*Assistant Examiner*—Alyson M Merlino
(74) *Attorney, Agent, or Firm*—Mark R. Malek, Esquire; Zies Widerman & Malek

(57) ABSTRACT

A lock member that pivotally engages a slide bolt movement member connected to a slide bolt of a locking astragal and that is moveable between locked and unlocked positions includes a user engagement portion and a lock portion. The user engagement portion is substantially flat and adapted to be flush with an outer surface portion of the slide bolt movement member when the lock member is in the locked position and the unlocked position. The lock portion is positioned opposite the user engagement portion, and has an unlocked side that is substantially flat and a locked side having an arcuate shape. The arcuate shaped lock side is positioned adjacent an interior portion of the slide bolt movement member when the lock member is in the locked position, and the substantially flat unlocked side is positioned adjacent the interior portion of the slide bolt movement member when the lock member is in the unlocked position.

15 Claims, 9 Drawing Sheets

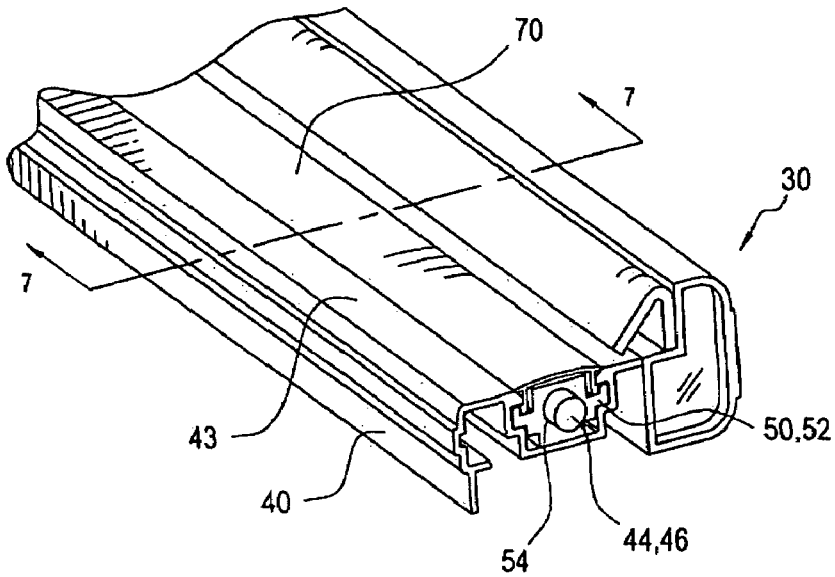
FIG. 6
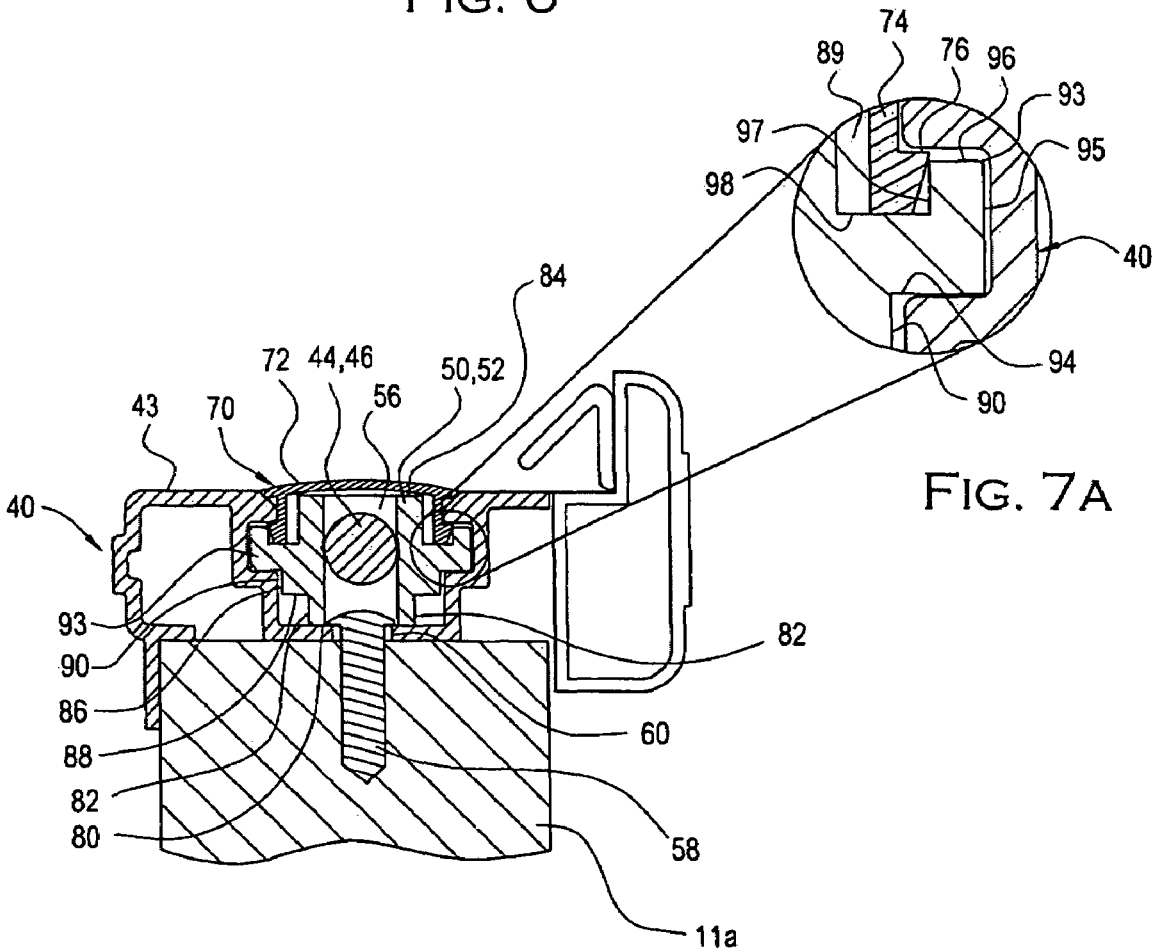
FIG. 7A
FIG. 7

LOCKING ASTRAGAL AND ASSOCIATED METHODS

RELATED APPLICATIONS

This application is a continuation-in-part of U.S. patent application Ser. No. 11/450,054 titled Astragal and Associated Methods filed on Jun. 9, 2006 by the inventor of the current application, the entire contents of which are incorporated herein by reference.

FIELD OF THE INVENTION

The present invention relates to the field of double door assemblies and, more particularly, to the field of a locking astragal to be mounted to an inactive door of a double door assembly.

BACKGROUND OF THE INVENTION

Double door assemblies generally include an inactive door and an active door. The active door may be selectively operated between opened and closed positions by a user. An inactive door is generally locked in place using a locking assembly provided by an astragal. A lock assembly, as illustrated, for example, in U.S. Pat. No. 6,457,751 to Hartman, may provide a slide bolt that may be extended from a disengaged position to an engaged position. When in the engaged position, the slide bolt may engage a door header and/or a floor to lock the inactive door in place. Of course, the slide bolt may be moved to a disengaged position so that the inactive door may also be operated between opened and closed positions.

Another astragal is disclosed, for example, in U.S. Pat. No. 5,590,919 to Germano. This astragal is provided as a single molding that extends the entire length of the inactive door. The astragal includes a base that may be connected to a door. A cap may be connected to an end portion of the base, and a sleeve connected to a side of the base. The sleeve is partially formed into the side of the base. Accordingly, such an astragal may provide some difficulties in construction.

A prior art astragal 10 is illustrated, for example, in FIG. 1. The prior art astragal 10 includes an elongate member 12, a pair of upper and lower stiffeners 14 carried by a slide bolt receiving passageway 17 formed in the elongate member, a pair of upper and lower slide bolt members 16, and elongate cover members 18. The prior art astragal 10 also includes respective upper and lower slide bolt movement members 22 and strike plates 24 adjacent a medial portion of the elongate member 12.

The stiffeners 14 are fastened to the elongate member 12 using a plurality of fasteners 26. Other fasteners 27 are used to mount the elongate member to a side portion of a door 11. The elongate cover members 18 are positioned to extend from the slide bolt movement members 22 to an end portion of the stiffeners 14. In other words, the stiffeners 14 are exposed, as are the fasteners 26 that mount the stiffeners to the elongate member 12. Fastener cover members 28 are positioned to overlie the fasteners 26 adjacent the stiffeners 14.

The fastener cover members 28 are generally provided by small plastic pieces. The fastener cover members 28 may, however, be lost in transit when the astragal 10 is being shipped to an installation site. Of course, this slows installation and greatly increases the cost of installation as new fastener cover members 28 must first be ordered and delivered to the installation site before being installed at a later date.

Referring now additionally to FIGS. 2 and 3, additional aspects of the prior art astragal 10 are now described in greater detail. More specifically, the elongate member 12 illustratively has a top wall 13. Similarly, the stiffener 14 also has a top wall 15 that is illustratively positioned flush with the top wall 13 of the elongate member 12.

Therefore, the elongate cover member 18 is positioned to overlie the elongate member 12, but only extends as far as the stiffener 14. Accordingly, the stiffener 14 remains exposed when the astragal 10 is positioned on a door 11. The fastener cover members 28 are also exposed when the astragal 10 engages the door 11. Accordingly, the prior art astragal 10 disadvantageously has an unfinished appearance when installed. Further, the exposed stiffener 14 may be a target for tampering. The prior art astragal 10 also requires strike plates 24 for operation after it has been installed. Again, this disadvantageously requires additional parts that may be lost when the prior art astragal 10 is en route to the installation site.

Complex locking mechanisms have been incorporated into some astragals to maintain the upper and lower slide bolts in the locked position. For example, U.S. Pat. No. 6,491,326 to Massey et al. discloses an astragal having a locking flush bolt assembly. The locking flush bolt assembly of the Massey et al. '326 patent application is connected to the flush bolt assembly and is rotatable to prevent the flush bolt from moving from the locked position to the unlocked position. More particularly, the locking mechanism includes a locking plug retainer and a rotatable locking plug that engages the locking plug retainer.

Another slide bolt locking system is disclosed in U.S. Pat. No. 6,905,152 to Hudson. The slide bolt locking system includes a lock member having a substantially rounded shape and a stop ledge protruding outwardly to engage a slot. This configuration, however, requires a precise alignment of the slide bolt movement member.

SUMMARY OF THE INVENTION

In view of the foregoing background, it is therefore an object of the present invention to provide an improved astragal to be mounted to an inactive door of a double door assembly that is easy to install. It is also an object of the present invention to provide an astragal that is aesthetically pleasing when installed. It is further another object of the present invention to provide an astragal to be mounted to an inactive door of a double door assembly that minimizes the amount of necessary loose parts. It is still further another object of the present invention to provide a locking astragal to be mounted to a door that allows a slide bolt to be maintained in a locked position.

These and other objects, features and advantages of the present invention are provided by a locking astragal comprising an elongate member having a slide bolt receiving passageway formed therein. The elongate member may include a plurality of fastener receiving passageways formed therethrough and is mountable to an inactive door of a double door assembly.

The locking astragal may also include an upper and a lower slide bolt carried by the elongate member. Each of the upper and lower slide bolts are moveable between locked and unlocked positions. The locking astragal may further include an upper and lower slide bolt movement member, each of which are preferably connected to the respective upper and lower slide bolts. The locking astragal may still further include an upper and lower stiffener. Each of the upper and lower stiffeners may be carried by the elongate member adjacent respective upper and lower portions of the slide bolt receiving passageway for receiving the respective upper and lower slide bolts.

A plurality of fasteners may be positioned to extend through the fastener receiving passageways formed through the elongate member. Each of the plurality of fasteners may have a top that protrudes above an upper portion of a bottom wall of the elongate member. A lock member may pivotally engage the upper and lower slide bolt movement members to be moved between locked and unlocked positions. When in the locked position, the respective upper and lower slide bolts may be maintained in the locked position. When in the unlocked position, the respective upper and lower slide bolts may be moveable between the locked and unlocked positions.

The lock member may include a user engagement portion and a lock portion. The user engagement portion is substantially flat and adapted to be flush with an outer surface portion of the upper and lower slide bolt movement members when the lock member is in the locked position and the unlocked position. The lock portion is preferably positioned opposite the user engagement portion and may include a lock portion having an unlocked side that is substantially flat and a locked side having an arcuate shape.

The substantially flat unlocked side of the lock portion may be moveable over the plurality of fasteners when the lock member is in the unlocked position. The arcuate shaped locked side of the lock portion may abuttingly contact the plurality of fasteners to maintain the upper and lower slide bolts in the locked position when the lock member is in the locked position. Accordingly, the slide bolts may advantageously be maintained in the locked position when the lock member is in the locked position, thereby enhancing security of the double door assembly.

Each of the upper and lower stiffeners may have a bottom wall, a pair of opposing sidewalls, a top wall overlying the bottom wall, and a pair of opposing guide members connected to and extending outwardly from the sidewalls. The upper and lower slide bolts may be moveable within the slide bolt receiving passageway between a locked position and an unlocked position.

The locking astragal may further comprise an upper stiffener carried by the elongate member adjacent an upper portion of the slide bolt receiving passageway. The upper stiffener may have a longitudinal passageway formed therethrough for receiving the upper slide bolt and a lateral passageway formed therethrough for receiving a fastener to mount the upper stiffener to the elongate member. A lower stiffener may be carried by the elongate member adjacent a lower portion of the slide bolt receiving passageway. The lower stiffener may have a longitudinal passageway formed therethrough for receiving the lower slide bolt and at least one lateral passageway formed therethrough for receiving a fastener to mount the lower stiffener to the elongate member.

The slide bolt receiving passageway may be defined by a bottom wall of the elongate member, a pair of opposing lower sidewalls connected to and extending upwardly from the bottom wall of the elongate member, a pair of medial walls connected to and extending outwardly from the lower sidewalls of the elongate member, a pair of upper sidewalls connected to and extending upwardly from the medial walls of the elongate member, and a pair of opposing lip members connected to and extending inwardly from the upper sidewalls of the elongate member. The top wall of each of the upper and lower stiffeners may have an elevation below the pair of opposing lip members of the elongate member.

Each of the opposing lip members may have an upper wall defined by an upper wall of the elongate member, a downwardly sloping side portion curving downwardly and away from the upper wall, a sidewall extending downwardly from the sloping side portion, and a bottom wall extending inwardly from the sidewall. The locking astragal may also comprise an elongate cover member that matingly engages the opposing lip members to overlie the slide bolt receiving passageway. The elongate cover member is preferably flush with the upper wall of the elongate member when positioned to overlie the slide bolt receiving passageway.

The elongate cover member may include an upper wall, and a pair of opposing sidewalls connected to and extending downwardly therefrom. The pair of opposing sidewalls may comprise an outwardly protruding lock member adjacent a bottom portion thereof to engage the respective pair of opposing bottom walls of the opposing upper lip members and lock the elongate cover member when positioned to overlie the slide bolt receiving passageway. This engagement may advantageously allow for the elongate cover member to be locked in position to overlie the slide bolt receiving passageway.

The elongate cover member may also comprise a lower elongate cover member extending from a bottom portion of the lower stiffener to a bottom portion of the lower slide bolt movement member, and an upper elongate cover member extending from an upper portion of the upper stiffener to an upper portion of the upper slide bolt movement member. The upper and lower stiffeners may further comprise a channel for receiving the elongate cover member. The channel may be defined as a space between the respective opposing sidewalls and the respective opposing guide members.

The elongate member may also comprise an integrally formed screw boss strike adjacent a medial portion thereof. The locking astragal may further comprise a strike plate removably connected to the screw boss strike. This configuration advantageously enhances the locking astragal by allowing the locking astragal to be used without the need for additional separate parts, or to allow the locking astragal to be customized by the user with a removable strike plate.

The elongate member may have lateral passageways adjacent an upper portion thereof and lateral passageways adjacent a lower portion thereof. Each of the respective lateral passageways may be aligned with the respective lateral passageways formed through each of the upper and lower stiffeners so that the respective fasteners may mount the respective upper and lower stiffeners to the elongate member and the elongate member to a door.

A method aspect of the present invention is for maintaining a locking astragal in a locked position when a slide bolt of the locking astragal is in a locked position. The method may include moving a lock member that pivotally engages a slide bolt movement member from an unlocked position to a locked position so that when the lock member is in the locked position, the arcuate shaped lock side is positioned adjacent an interior portion of the slide bolt movement member, and when the lock member is in the unlocked position, the flat side is positioned adjacent the interior portion of the slide bolt movement member.

BRIEF DESCRIPTION OF THE DRAWINGS

FIG. 6 is a partial perspective view of the astragal shown in FIG. 5.

FIG. 7 is a cross-sectional view of the astragal shown in FIG. 6 taken through line 7-7.

FIG. 7A is an enlarged partial perspective view of an element of the astragal shown in FIG. 6.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
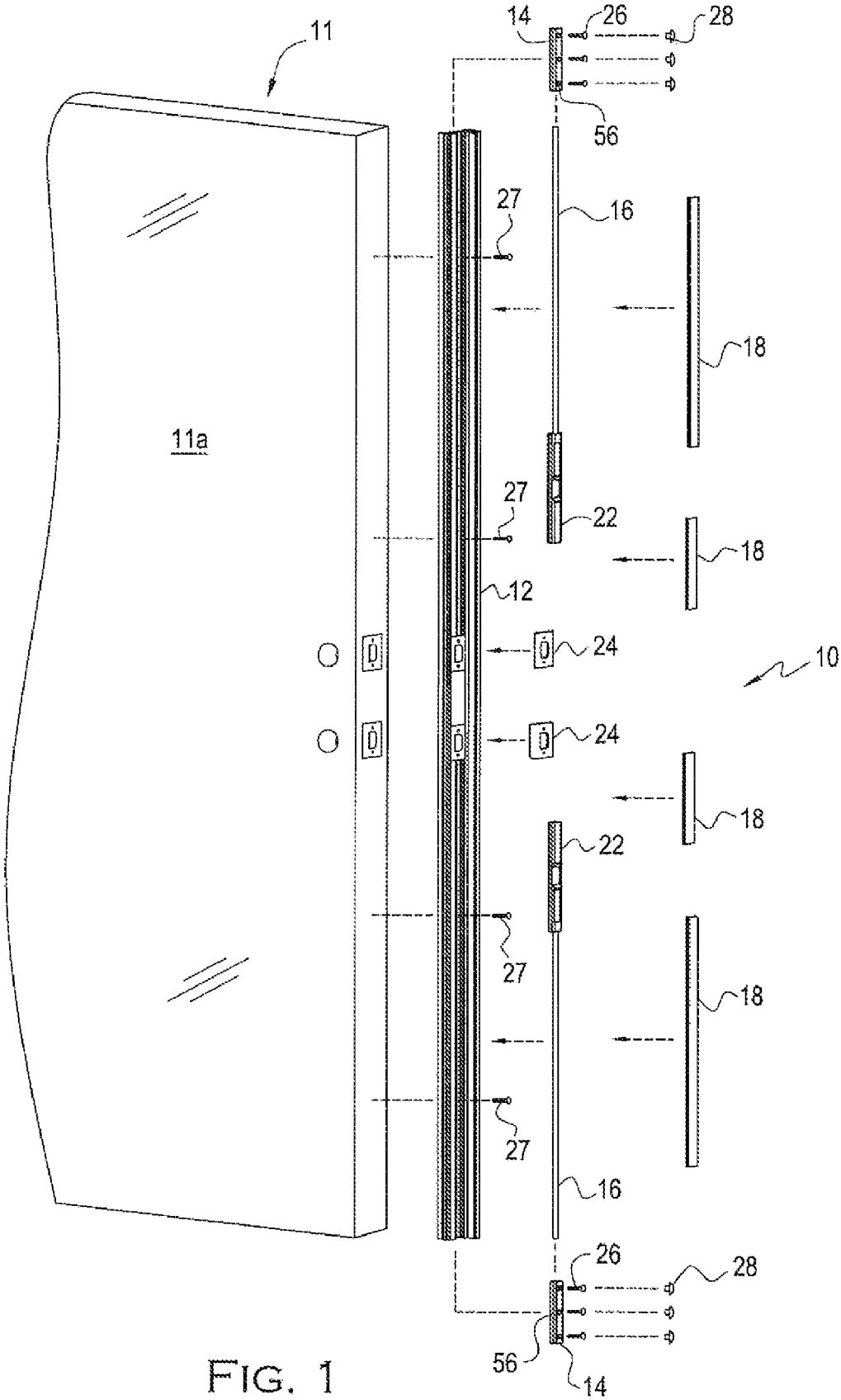
FIG. 1 (PRIOR ART)
FIG. 1 is an exploded partial perspective view of a prior art astragal being mounted to a double door assembly.
Figure 2:
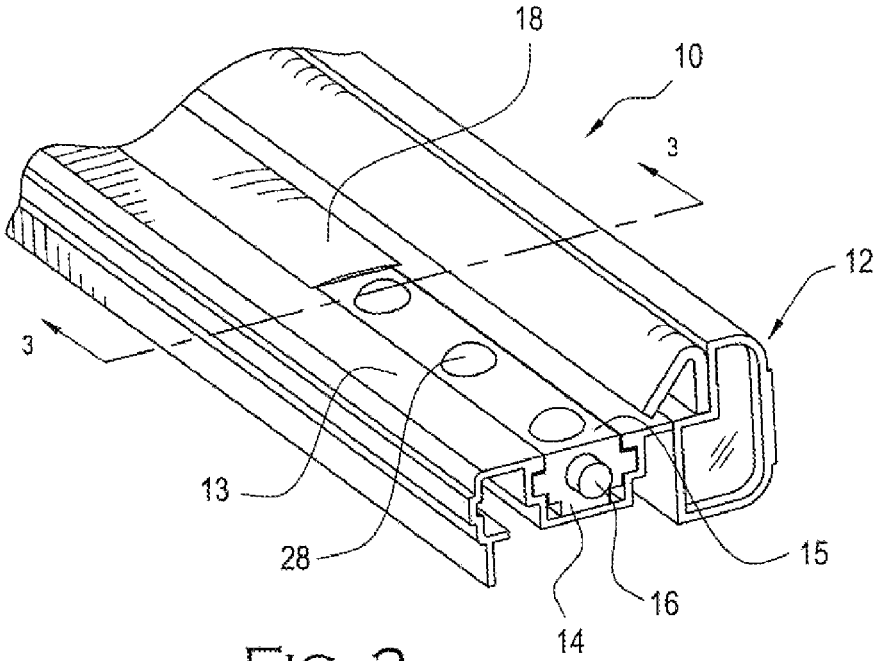
FIG. 2 (PRIOR ART)
FIG. 2 is a partial perspective view of an astragal according to the prior art.
Figure 3:
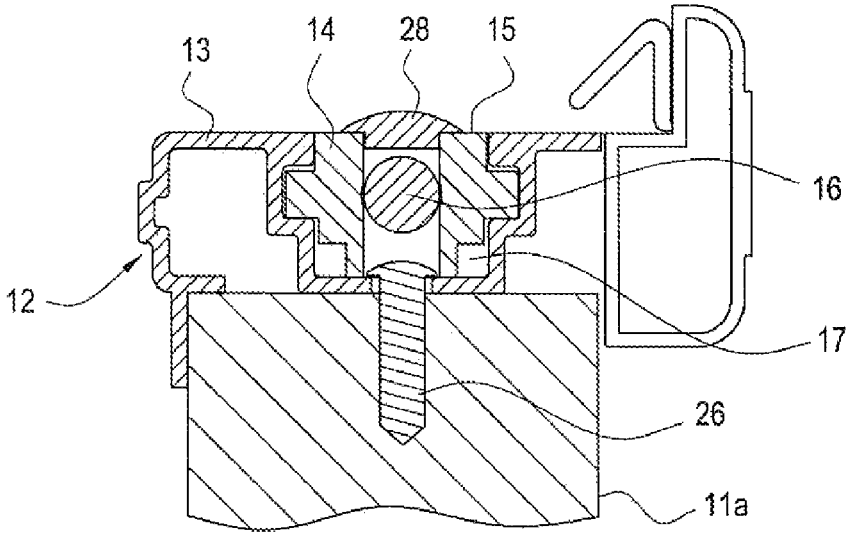
FIG. 3 (PRIOR ART)
FIG. 3 is a sectional view taken through line 3-3 in FIG. 2 of an astragal according to the prior art.
Figure 4:
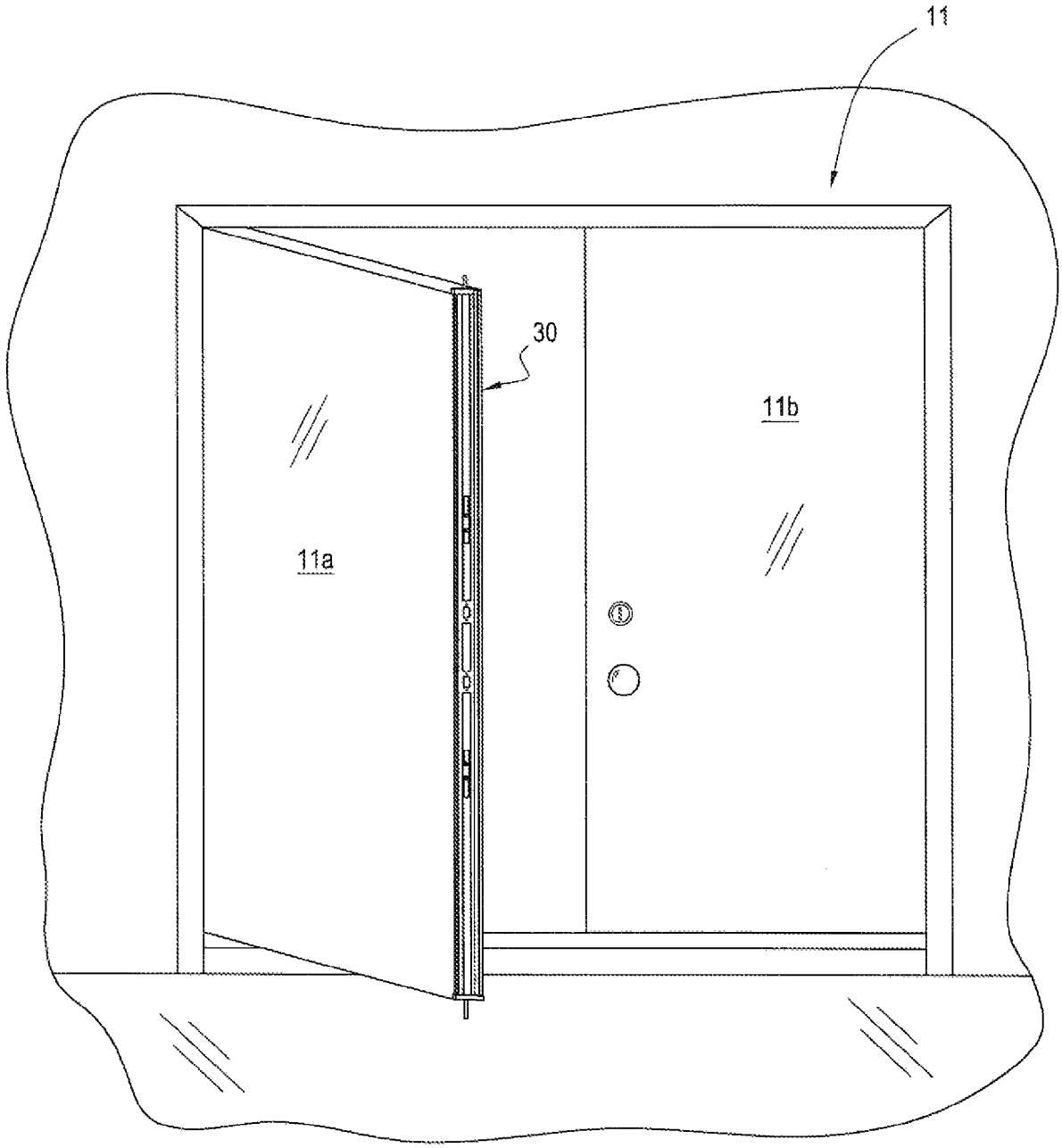
FIG. 4 is an environmental view of an astragal mounted to a door according to the present invention.

Referring now to FIGS. 4-7, the astragal 30 in accordance with the present invention is now described in greater detail. As illustrated in FIG. 4, for example, the astragal 30 is illustratively mounted to an end of a door 11. More specifically, the astragal 30 of the present invention is illustratively used with a double door assembly and is connected to an end of an inactive door 11*a*. The inactive door 11*a* preferably remains closed while an active door 11*b* may be moved between opened and closed positions. Of course, when the astragal 30 is moved from a locked to an unlocked position, the inactive door 11*a* may be selectively opened, as illustrated, for example, in FIG. 4. Although not illustrated herein, those skilled in the art will appreciate that the astragal 30 may be moved to a locked position when the inactive door 11*a* is in a closed position to keep the inactive door closed so that the active door 11*b* may be opened and closed adjacent the inactive door.

Figure 5:
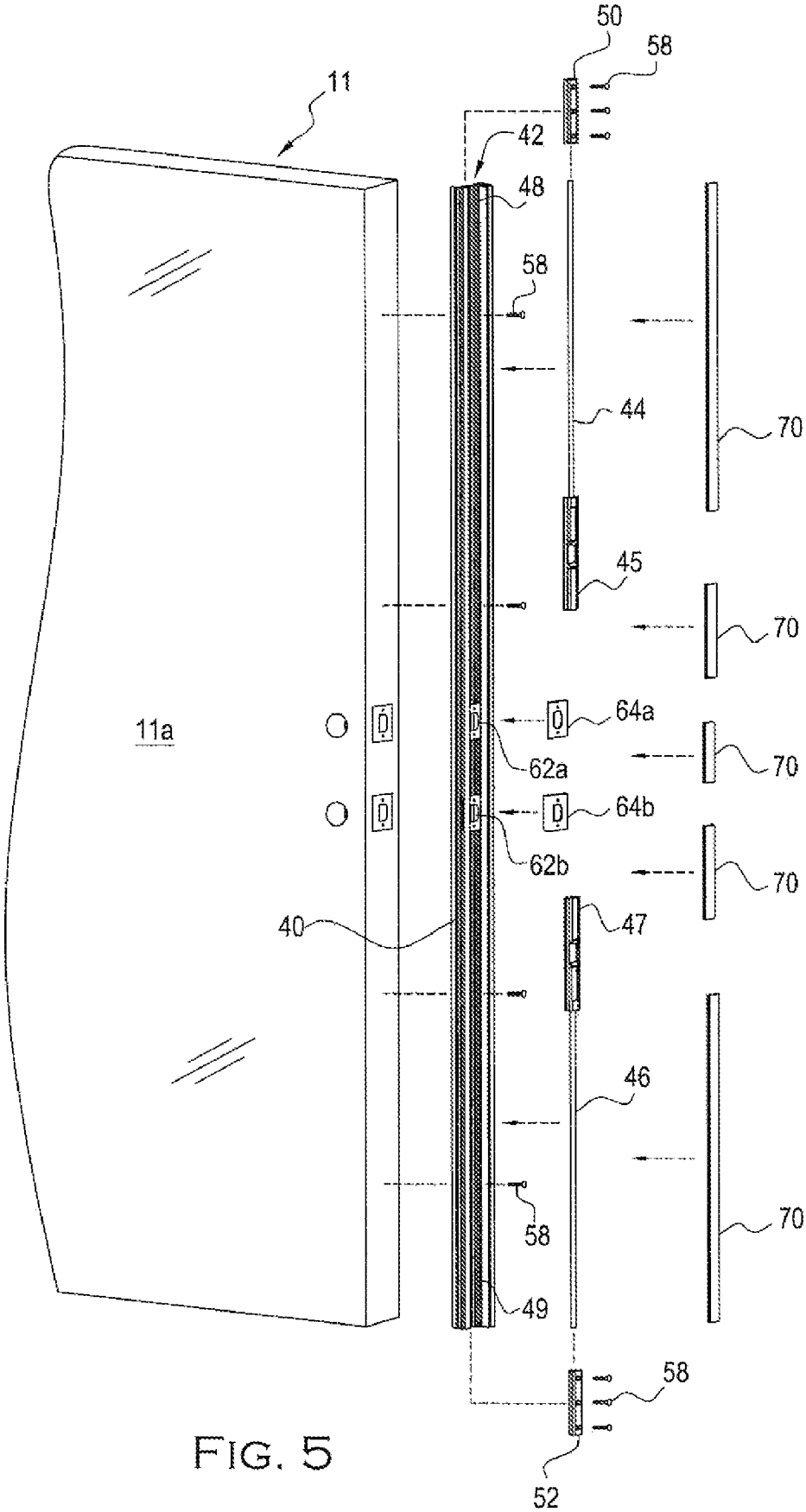
FIG. 5 is an exploded partial perspective view of an astragal according to the present invention.

Referring now more specifically to FIG. 5, additional aspects of the astragal 30 of the present invention are now described in greater detail. The astragal 30 illustratively includes an elongate member 40 having a slide bolt receiving passageway 42 formed therein. The elongate member 40, which will be described in greater detail below, is preferably made of an extruded aluminum material. Those skilled in the art, however, will appreciate that the elongate member 40 may be made of any other material having similar strength properties, such as composite or plastic material, for example, and, preferably, similar light-weight properties.

The astragal 30 also includes an upper slide bolt 44 and a lower slide bolt 46. The upper slide bolt 44 is carried by the elongate member 40 and is moveable within the slide bolt receiving passageway 42 between a locked position and an unlocked position. Similarly, the lower slide bolt 46 is also carried by the elongate member 40 and is moveable within the slide bolt receiving passageway 42 between a locked position and an unlocked position. Those skilled in the art will appreciate that the upper slide bolt 44 may be moved to the locked position to engage a slide bolt receiving recess (not shown) formed in a door header, and the lower slide bolt 46 may be moved to the locked position to engage a slide bolt receiving recess (not shown) formed in a floor or threshold.

The astragal 30 further comprises an upper slide bolt movement member 45 and a lower slide bolt movement member 47. The upper slide bolt movement member 45 is illustratively connected to the upper slide bolt 44, and the lower slide bolt movement member 47 is illustratively connected to the lower slide bolt 46. The upper and lower slide bolt movement members 45, 47 move the respective upper and lower slide bolts 44, 46 between the locked and unlocked positions.

More specifically, the upper and lower slide bolt movement members 45, 47 preferably have a curved shape to accommodate a thumb, or finger, for example, of a user. Those skilled in the art, however, will appreciate that the upper and lower slide bolt movement members 45, 47 may have any shape. Accordingly, the upper and lower slide bolts 44, 46 slidably move between locked and unlocked positions responsive to engagement of the upper and lower slide bolt movement members 45, 47 by a user.

The astragal 30 further illustratively comprises an upper stiffener 50 and a lower stiffener 52. The upper stiffener 50 is carried by the elongate member 40 adjacent an upper portion 48 of the slide bolt receiving passageway 42. Similarly, the lower stiffener 52 is carried by the elongate member 40 adjacent a lower portion 49 of the slide bolt receiving passageway 42. The upper and lower stiffener 50, 52 advantageously enhance security of the double door assembly. More specifically, the stiffeners 50, 52 are preferably made of a rigid aluminum material, but those skilled in the art will appreciate that the stiffeners may, for example, be made of any other type of material having similar strength properties and, preferably be light in weight, such as plastic and other composite materials, for example.

As perhaps best illustrated in FIGS. 6 and 7, the upper and lower stiffeners 50, 52 have a longitudinal passageway 54 formed therethrough. The upper and lower slide bolts 44, 46 slidably engage the longitudinal passageway 54 formed in each of the respective upper and lower stiffeners 50, 52. Accordingly, the upper and lower slide bolts 44, 46 preferably always slidably engage the longitudinal passageways 54 and are in communication therewith when being moved between the locked to the unlocked positions.

The upper and lower stiffeners 50, 52 preferably have a plurality of lateral passageways 56 formed therethrough. The lateral passageways 56 are positioned to receive fasteners 58 to mount the upper stiffener 50 to the elongate member 40, and to mount the lower stiffener 52 to the elongate member. Accordingly, the upper and lower stiffeners 50, 52 are fixedly connected to the elongate member 40 and remain stationary as the upper and lower slide bolts 44, 46 move between the locked and the unlocked positions. The fasteners 58 may, for example, be provided by screws, but those skilled in the art will appreciate that any other type of fasteners may be used to fasten the respective upper and lower stiffeners 50, 52 to the elongate member 40. Although a plurality of lateral passageways 56 are illustrated in each of the upper and lower stiffeners 50, 52, those skilled in the art will appreciate that any number of lateral passageways may be formed in the upper and lower stiffeners to receive fasteners to mount the upper and lower stiffeners to the elongate member 40.

The elongate member 40 may have lateral passageways 60 formed therethrough adjacent the upper and lower portions thereof. More specifically, the lateral passageways 60 may be formed through the elongate member 40 adjacent the upper and lower portions of the slide bolt receiving passageway 48, 49. Each of the respective lateral passageways 60 are preferably aligned with the lateral passageways 56 on the upper and lower stiffeners 50, 52 so that the fasteners 58 mount the respective upper and lower stiffeners to the elongate member 40 and the elongate member to an end portion of the inactive door 11*a* of the double door assembly. Again, this arrangement advantageously secures the upper and lower stiffeners 50, 52 so that they are fixed to the elongate member 40 and remain stationary as the upper and lower slide bolts 44, 46 move between the locked and unlocked positions.

The elongate member 40 further comprises a pair of integrally formed screw boss strikes 62 adjacent a medial portion thereof. A first screw boss strike 62*a* may be used to engage a dead bolt. A second screw boss strike 62*b* may be used to engage a door latch. Those skilled in the art will appreciate that although a pair of screw boss strikes 62*a*, 62*b* are illustrated, any number of screw boss strikes may be integrally formed into the elongate member 40 of the astragal of the present invention.

The astragal 30 may also comprise strike plates 64 removably connected to the screw boss strikes 62. More specifically, a first strike plate 64*a* may be used to overlie the first screw boss strike 62*a*, and a second strike plate 64*b* may be used to overlie the second screw boss strike 62*b*. The screw boss strikes 62 advantageously have a finished appearance so that strike plates 64 are not required to complete installation of the astragal 30 of the present invention. The strike plates 64, however, may be selectively used to provide the astragal 30 with a predetermined desired appearance.

Those having skill in the art will appreciate that the screw boss strikes 62 may be used as backing spacers for the strike plates 64 to advantageously prevent the strike plates from bending, collapsing, or moving after fasteners have been installed to fasten the strike plates to the screw boss strikes. Strike plates 64 throughout the industry may have varying hole patterns for receiving fasteners. The screw boss strikes 62 advantageously allow for use of the astragal 30 without the need for strike plates 64 in cases where the hole pattern of the strike plates does not align with holes formed in the screw boss strikes 62 for receiving fasteners.

The astragal 30 also illustratively includes an elongate cover member 70 that engages the elongate member 40 to overlie the slide bolt receiving passageway 42. Additional details of the elongate cover member 70 are provided below.

Referring now, more specifically to FIGS. 7 and 7A, additional details of the upper and lower stiffeners 50, 52 are now provided. Each of the upper and lower stiffeners 50, 52 have a bottom wall 80, a pair of opposing sidewalls 82 connected to and extending upwardly from the bottom wall, and a top wall 84 connected to the pair of opposing sidewalls. Further, each of the stiffeners 50, 52 includes a pair of opposing guide members 86 connected to and extending outwardly from the sidewalls 82.

Referring now with specificity to FIG. 7A, an enlarged view of the guide member 86 is shown to provide additional details. Each of the guide members 86 is defined by a bottom wall 88 and a sidewall 90 extending upwardly from the bottom wall. Each guide member 86 is also defined by an L-shaped member 93 connected to and extending outwardly from the sidewall 90 of the guide member 86 and the sidewall 82 of the stiffener. More particularly, the L-shaped member includes a bottom wall 94, an exterior sidewall 95 connected to the bottom wall and extending upwardly therefrom, a top wall 96 connected to the exterior sidewall, an interior sidewall 97 opposing the exterior sidewall and connected to the top wall, and a medial wall 98 connected to the interior sidewall and extending to the sidewall 90 of the stiffeners 50, 52.

Figure 7B:
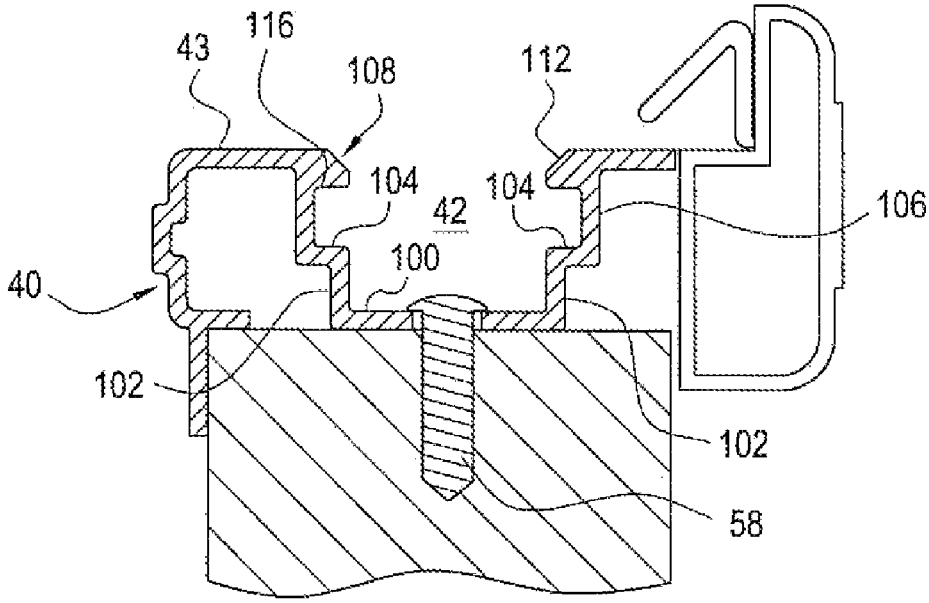
FIG. 7B is a cross-sectional view of the elongate member of the astragal shown in FIG. 6 with the stiffeners removed.

Each of the stiffeners 50, 52 are positioned to engage the slide bolt receiving passageway 42. More specifically, the guide members 86 on the stiffeners 50, 52 matingly engage portions of the slide bolt receiving passageway 42 so that the stiffeners may be securely carried by the elongate member 40. Referring now with specificity to FIG. 7B, additional details of the slide bolt receiving passageway 42 are now described in greater detail. The slide bolt receiving passageway 42 may be defined by a bottom wall 100 of the elongate member 40, and a pair of opposing lower sidewalls 102 connected to and extending upwardly from the bottom wall of the elongate member. The slide bolt receiving passageway 42 is further defined by a pair of medial walls 104 connected to and extending outwardly from the lower sidewalls 102 of the elongate member 40, and a pair of upper sidewalls 106 connected to and extending upwardly from the medial walls of the elongate member. The slide bolt receiving passageway 42 is still further defined by a pair of opposing lip members 108 connected to and extending inwardly from the upper sidewalls 106 of the elongate member 40.

The details of the upper and lower stiffeners 50, 52 and the slide bolt receiving passageway 42 formed in the elongate member 40 having been described above, the relationship between the upper and lower stiffeners and the elongate member may now be described in greater detail. More specifically, the top wall 84 of each of the upper and lower stiffeners 50, 52 have an elevation below the pair of lip members 108 of the elongate member 40.

As will be described in greater detail below, the lower elevation of the top wall 84 of the upper and lower stiffeners 50, 52 advantageously allows the elongate cover member 70 to overlie the slide bolt receiving passageway 42 and the stiffeners so that the stiffeners are concealed from view when the astragal 30 of the present invention is mounted to an inactive door 11*b*. Further, the positioning of the elongate cover member 70 over the slide bolt receiving passageway and the upper and lower stiffeners 50, 52 also advantageously eliminates the need for fastener cover members 28 as used in prior art astragals 10. The elongate cover member 70 further advantageously provides a finished look to the astragal 30 of the present invention along the entire length thereof.

Each of the opposing lip members 108 of the elongate member 40 are now described in greater detail. The opposing lip members 108 each have an upper wall defined as an upper wall 43 of the elongate member 40. In other words, the upper wall of each opposing lip member is integrally formed with the upper wall 43 of the elongate member 40. Further, each of the opposing lip members 108 has a downwardly sloping side portion 112 that slopes downwardly and away from the upper wall 43 of the elongate member 40. Each of the opposing lip members 108 also includes a sidewall 114 extending downwardly from the sloping side portion 112, and a bottom wall 116 extending inwardly from the sidewall. More particularly, the bottom wall 116 extends inwardly to the upper sidewall 106 of the elongate member.

Figure 7C:
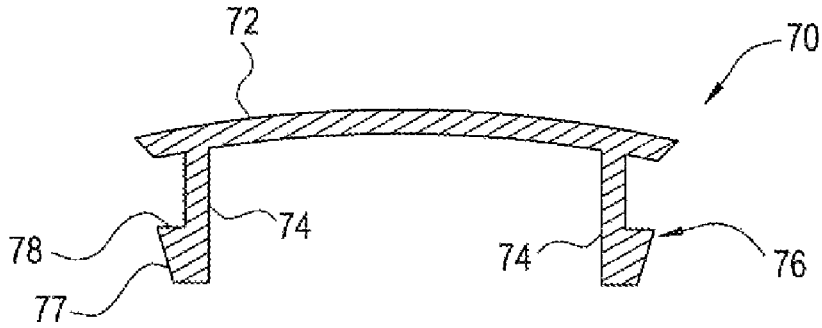
FIG. 7C is a cross-sectional view of an elongate cover member of the astragal shown in FIG. 6.
Figure 8:
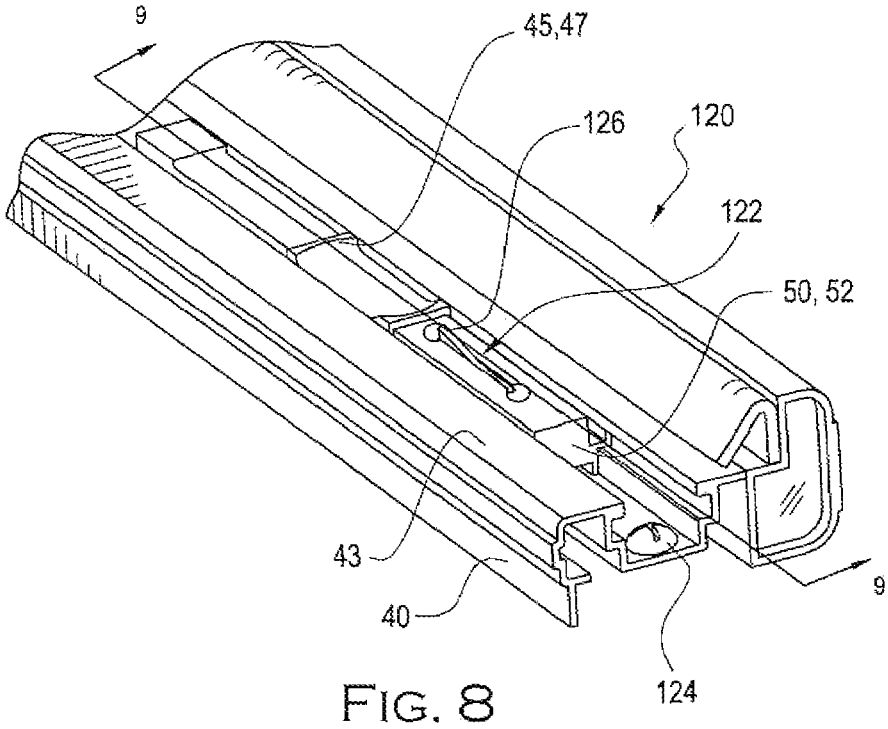
FIG. 8 is a prospective view of a locking astragal according to the present invention.

Referring now with specificity to FIG. 7C, the elongate cover member 70 is now described in greater detail. As referenced above, the elongate cover member 70 matingly engages the elongate member 40 to overlie the slide bolt receiving passageway 42. More specifically, the elongate cover member 70 matingly engages the opposing lip members 108 of the elongate member 40 to overlie the slide bolt receiving passageway 42 and the upper and lower stiffeners 50, 52.

End portions of the elongate cover member 70 are preferably positioned flush with the upper wall 43 of the elongate member 40 when positioned to overlie the slide bolt receiving passageway 42 and the upper and lower stiffeners 50, 52. More specifically, end portions of the elongate cover member 70 overlie the downwardly sloping side portions 112 of the lip members 80 so that the end portions may be slightly recessed and sit flush with the top wall 43 of the elongate member 40. The elongate cover member 70 includes an upper wall 72 and a pair of opposing sidewalls 74 connected to and extending downwardly therefrom. The pair of opposing sidewalls 74 comprise outwardly protruding lock members 76 adjacent a bottom portion thereof to engage the respective bottom walls 116 of the lip members 110. The engagement of the lock members 76 with the bottom walls 116 of the lip members 110 lock the elongate cover member 70 to the elongate member 40 when overlying the slide bolt receiving passageway 42 and the upper and lower stiffeners 50, 52.

The lock members 76 include a sloping exterior sidewall 77 and a medial wall 78 connected thereto. The sloping exterior sidewall 77 allows for the elongate cover member 70 to be matingly engaged with the elongate member 40, by simply applying a downward force to the upper wall 72 of the elongate cove member. The medial wall 78 has a horizontal configuration to be positioned adjacent the bottom wall 116 of the elongate member 40 allowing the elongate cover member to be locked in place when positioned to overlie the slide bolt receiving passageway 42 and the upper and lower stiffeners 50, 52.

As perhaps best illustrated in FIG. 5, the elongate cover member 70 comprises a plurality of elongate cover members. A lower elongate cover member may be positioned to extend from a bottom portion of the lower stiffener 52 to a bottom portion of the lower slide bolt movement member 47. An upper elongate cover member may be positioned to extend from an upper portion of the upper stiffener 50 to an upper portion of the upper slide bolt movement member 45. Further, elongate cover members may be positioned to extend between the upper and lower slide bolt movement members 45, 47 and the strike plates 62*a*, 62*b*. The elongate cover member 70 may, for example, be provided by nylon or rigid vinyl material. Those skilled in the art, however, will appreciate that the elongate member 40 may be made with any other type of material having similar properties.

The upper and lower stiffeners 50, 52 also illustratively include a channel 89 for receiving the elongate cover member 70. The channel 89 is preferably defined as a space between the respective opposing sidewalls 82 of the upper and lower stiffeners 50, 52 and the respective opposing guide members 86.

A method aspect of the present invention is for installing an. astragal 30. The method includes positioning the elongate member 40 adjacent an end portion of an inactive door 11*a* on a double-door assembly. The method also includes positioning stiffeners 50, 52 adjacent respective upper and lower portions of the elongate member 40.

The method further includes mounting the stiffeners 50, 52 to the elongate member 40 and mounting the elongate member to the door 11. The stiffeners 50, 52 are mounted to the elongate member 40 and the elongate member is mounted to the door 11 using fasteners 58 that are passed through the lateral passageways 56 formed in the stiffeners and the elongate member. More specifically, the lateral passageways 56 in the stiffeners 50, 52 are aligned with the lateral passageways in the elongate member 40 so that the fasteners 26 may be passed through the passageways to readily mount the elongate member to the inactive door 11*a* on the double door assembly.

The method also advantageously includes matingly engaging the elongate cover member 70 with the elongate member 40 to overlie the slide bolt receiving passageway 42 and the upper and lower stiffeners 50, 52. More specifically, the elongate cover member 70 is positioned so that end portions of the upper wall of the elongate cover member are positioned flush with the upper wall 43 of the elongate member 40. This advantageously enhances the aesthetics of the astragal 30 of the present invention as it provides the astragal with a finished look throughout. This also advantageously enhances security of the astragal 30 as it prevents tampering therewith. The elongate cover member 70 also advantageously eliminates the need for fastener cover members 28 as required in prior art astragals 10.

Referring now additionally to FIGS. 8-12, a locking astragal 120 according to the present invention is now described in greater detail. The locking astragal 120 includes similar features to the astragal 30 described above, and advantageously includes a lock member 122, the upper slide bolt 44 and lower slide bolt 46 in the locked positions. Accordingly, several aspects of the locking astragal 120 has been defined above as the bottom wall 100 of the slide bolt receiving passageway 42. The plurality of fasteners 124 are preferably positioned so that a top portion of the fasteners protrude above an upper portion of the bottom wall 100 of the slide bolt receiving passageway 42, i.e., a bottom portion of the elongate member 40.

The locking astragal 120 includes a lock member 122 that pivotally engages the upper slide bolt movement member 45 and the lower slide bolt movement member 47. Those skilled in the art will appreciate that the lock member 122 may be used on both the upper and the lower slide bolt movement members 45, 47, or for a selected one of the upper and lower slide bolt movement members.

The lock member 122 may be moved between a locked position and an unlocked position. When the lock member 122 is in the locked position, the respective upper and lower slide bolts 44, 46 are maintained in the locked position. When the lock member 122 is in the unlocked position, the respective upper and lower slide bolts 44, 46 may be moved between the locked and unlocked positions.

The lock member 122 includes a user engagement portion 126 that is illustratively substantially flat. More particularly, the user engagement portion is adapted to be flush with an outer surface portion of the upper and lower slide bolt movement members 45, 47 when in the locked position and the unlocked position. The upper and lower slide bolt movement members 45, 47 include recesses adjacent the user engagement portion 126 of the locked member 122 so that a user may engage an end portion of the user engagement portion 126. More specifically, the recesses formed in the upper and lower slide bolt movement members 45, 47 provide a space adjacent the end of the user engagement portion 126 of the locked member so that a user may engage the end to pivot the locked member between the locked and unlocked positions. Indicia may be positioned adjacent the recesses on the upper and lower slide bolt movement members 45, 47 to indicate to a user the location of the locked position and the unlocked position.

The lock member 122 also includes a lock portion 128 opposite the user engagement portion 126. The lock portion 128 includes a locked side 130 and an unlocked side 132 opposite the locked side. The unlocked side 132 of the lock portion 128 is substantially flat, and the locked side 130 of the lock portion preferably has an arcuate shape.

The substantially flat unlocked side 132 of the locked portion 128 is moveable over the fasteners 124 when the locked member 122 is in the unlocked position. Further, the arcuate shape locked side 130 of the locked portion 128 abutingly contacts the plurality of fasteners 124 to maintain the upper and lower slide bolts 44, 46 in the locked position when the lock member 122 is in the locked position. The lock portion 128 and user engagement position 126 of the lock member 122 are preferably integrally formed as a monolithic unit. Further, the pivotal connection between the lock member 122 and the slide bolt movement members 45, 47 may be provided by a pin positioned to extend through the lock member and having ends that engage releases formed in the slide bolt movement members. Alternately, the lock member 122 may include a pair of opposing lock tabs that extend outwardly from the lock position 128. The pair of lock tabs may engage lock tab saddles on the slide bolt movement members to allow for the pivotal movement of the lock member 122. The other aspects of the locking astragal 120 are similar to those of the astragal 30 defined above, are similarly labeled, and require no further discussion herein.

Operation of the lock member 122 of the locking astragal 120 is now described in further detail. More specifically, to maintain the upper and lower slide bolts 44, 46 in the locked position, a user may move the lock. member 122 from the unlocked position to the locked position.

Figure 9:
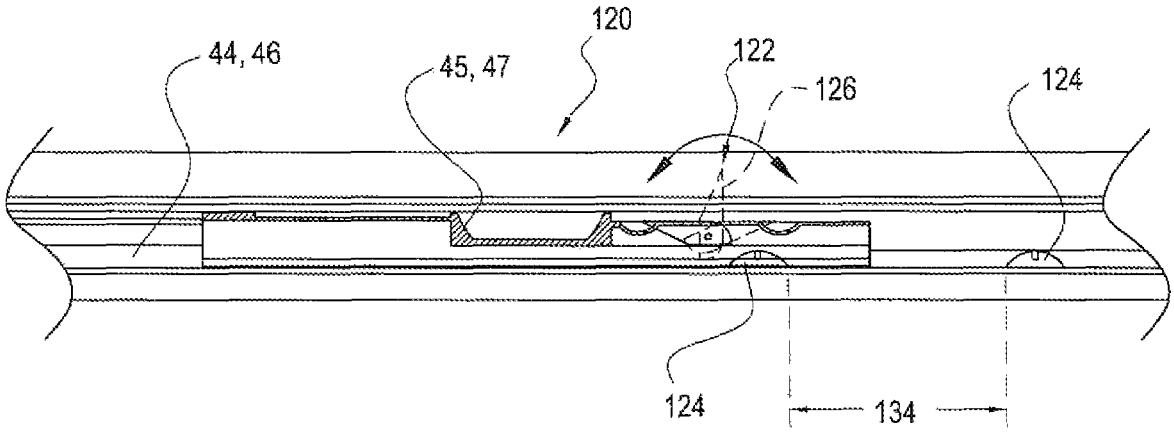
FIG. 9 is a cross-sectional view of the locking astragal shown in FIG. 8 taken through line 9-9.
Figure 10:
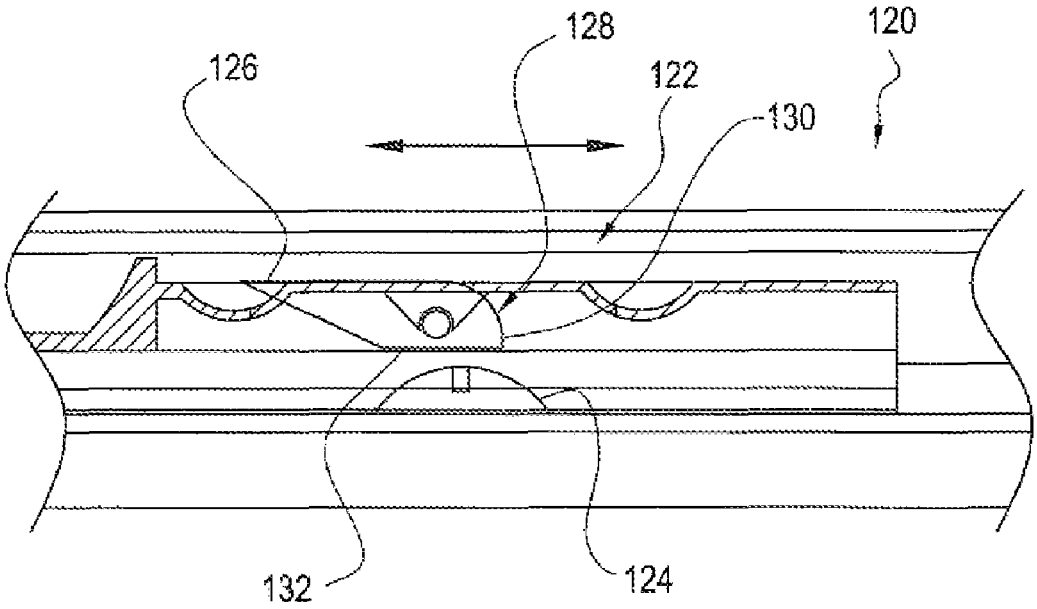
FIG. 10 is a cross-sectional view of a locking astragal showing a lock member pivotally connected to a slide bolt engagement member and in the unlocked position.

As perhaps best illustrated in FIG. 9, the plurality of fasteners 124 extend through the elongate member 40 and are positioned such that the area between the two fasteners may be defined as a locked area 134. When the upper and lower slide bolts 44, 46 are in the unlocked position, the lock member 122 is preferably positioned outside of the locked area 134. To move the upper and lower slide bolts 44, 46 to the locked position, a locked member 122 must first be moved to the unlocked position as illustrated, for example, in FIG. 10. After the lock member 122 is positioned in the unlocked position, the substantially flat unlocked side 132 of the lock member may be freely moved over the fasteners 124. In other words, when the lock member 122 is in the unlocked position, clearance is provided between the substantially flat unlocked side 132 of the lock member and the fasteners, thereby allowing the slide bolt movement members 45, 47 to freely move into and out of the locked area 134.

Figure 11:
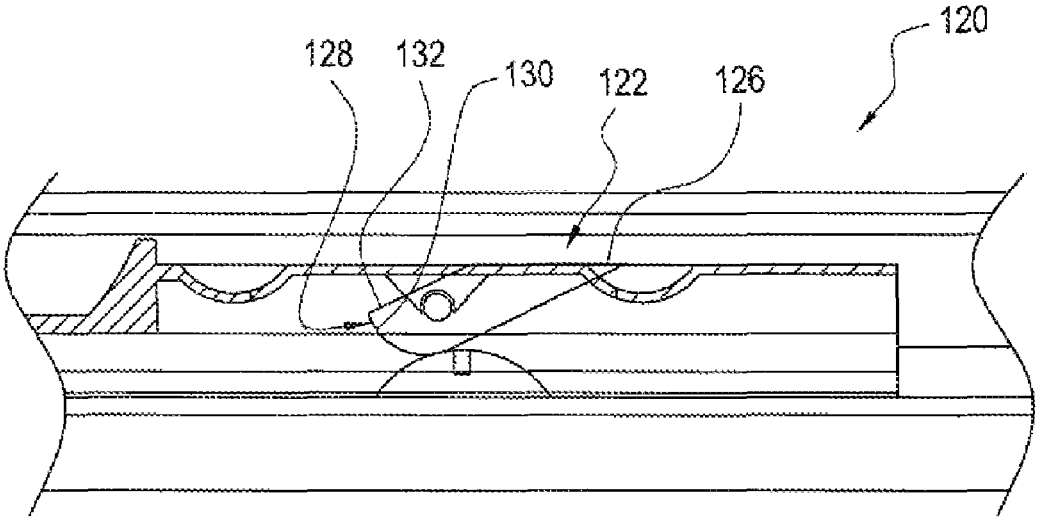
FIG. 11 is a cross-sectional view of the locking astragal showing a lock member in the locked position.
Figure 12:
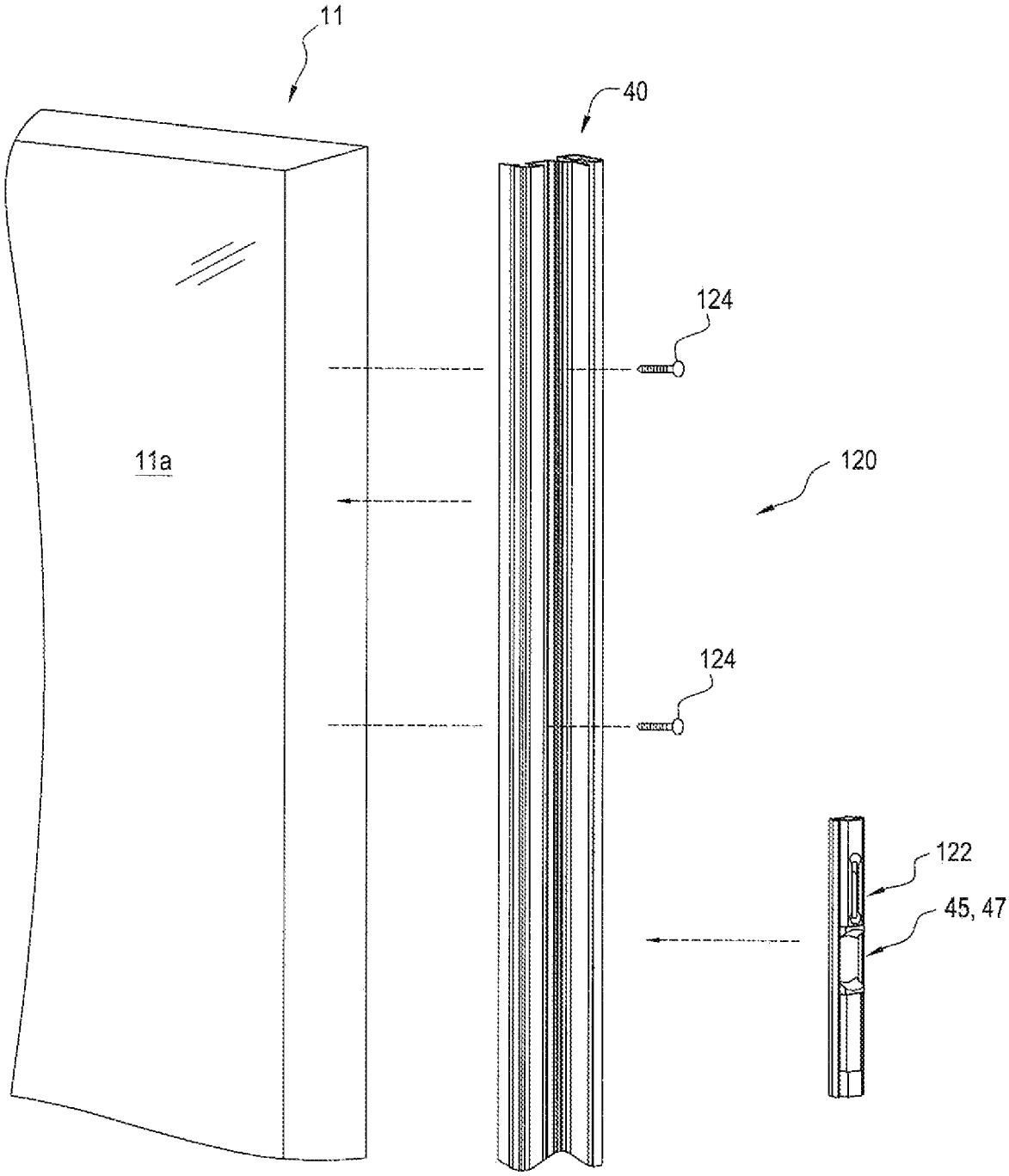
FIG. 12 is an exploded partial prospective view of a locking astragal according to the present invention.

After the lock member 122 is moved to the locked area 134, the locked member may be moved to the locked position as illustrated, for example, in FIG. 11. When in the locked position, the locked side 130 of the locked portion 128 may abutingly contact the fasteners 124, preventing movement of the upper and lower slide bolts 44, 46 outside of the locked area 134.

To move the upper and lower slide bolts 44, 46 from the locked position to the unlocked position, a user may simply engage the lock member 122 on the upper and lower slide bolt movement members 45, 47 and pivot the lock member from the locked position, wherein the locked side 130 of the locked portion 128 abutingly contacts the fasteners 124, to the unlocked position, wherein the substantially flat unlocked side 132 of the locked portion faces the fasteners so that the upper and lower slide bolt movement members may be freely moved from the locked area 134 to outside of the locked area.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A locking astragal comprising:

an elongate member having a slide bolt receiving passageway formed therein, said elongate member including a plurality of fastener receiving passageways formed therethrough and being mountable to an inactive door of a double door assembly;

an upper and a lower slide bolt carried by said elongate member, each being moveable between locked and unlocked positions;

an upper and a lower slide bolt movement member, each connected to said respective upper and lower slide bolts;

an upper and a lower stiffener, each carried by said elongate member adjacent respective upper and lower portions of the slide bolt receiving passageway, so that said respective upper and lower slide bolts engage said respective upper and lower stiffeners when carried by said elongate member and moved between the locked and unlocked positions;

a plurality of fasteners positioned to extend through the fastener receiving passageways formed through the elongate member, each of said plurality of fasteners having a top that protrudes above an upper portion of a bottom wall of said elongate member; and a lock member that pivotally engages a respective one of said upper and lower slide bolt movement members, wherein said lock member is moveable between locked and unlocked positions so that when in the locked position, a respective one of said upper and lower slide bolts is maintained in the locked position, and when moved to the unlocked position, a respective one of said upper and lower slide bolts is moveable between the locked and unlocked position, said lock member comprising:

a user engagement portion that is substantially flat and adapted to be flush with an outer surface portion of a respective one of said upper and lower slide bolt movement members when said lock member is in the locked position and the unlocked position, and a lock portion opposite the user engagement portion, the lock portion having an unlocked side that is substantially flat and a locked side having an arcuate shape wherein the arcuate shaped locked side abuttingly contacts one of said plurality of fasteners to maintain a respective one of said upper and lower slide bolts in the locked position when the lock member is in the locked position and wherein the substantially flat unlocked side is positioned adjacent the interior portion of a respective one of said upper and lower slide bolt movement members when the lock member is in the unlocked position.

2. A locking astragal according to claim 1 wherein each of said upper and lower stiffeners have a bottom wall, a pair of opposing sidewalls, a top wall overlying said bottom wall, and a pair of opposing guide members connected to and extending outwardly from said sidewalls; and wherein said upper and lower slide bolts are moveable within the slide bolt receiving passageway between locked and an unlocked positions.

3. A locking astragal according to claim 1, wherein said upper stiffener is carried by said elongate member adjacent an upper portion of the slide bolt receiving passageway, the upper stiffener having a longitudinal passageway formed therethrough for receiving said upper slide bolt and at least one lateral passageway formed therethrough for receiving at least one fastener to mount said upper stiffener to said elongate member; and said lower stiffener is carried by said elongate member adjacent a lower portion of the slide bolt receiving passageway, the lower stiffener having a longitudinal passageway formed therethrough for receiving therethrough for receiving said lower slide bolt and at least one lateral passageway formed therethrough for receiving at least one fastener to mount said lower stiffener to said elongate member.

4. A locking astragal according to claim 3 wherein the slide bolt receiving passageway is defined by a bottom wall of said elongate member, a pair of opposing lower sidewalls connected to and extending upwardly from the bottom wall of said elongate member, a pair of medial walls connected to and extending outwardly from the lower sidewalls of said elongate member, a pair of upper sidewalls connected to and extending upwardly from the medial walls of said elongate member, and a pair of opposing lip members connected to and extending inwardly from said upper sidewalls of said elongate member, and wherein the top wall of each of said upper and lower stiffeners has an elevation below said pair of opposing lip members of said elongate member.

5. A locking astragal according to claim 4 wherein each of said opposing lip members have an upper wall defined by an upper wall of said elongate member, a downwardly sloping side portion curving downwardly and away from the upper wall, a sidewall extending downwardly from the sloping side portion, and a bottom wall extending inwardly from the sidewall.

6. A locking astragal according to claim 5 further comprising an elongate cover member that matingly engages the opposing lip members to overlie the slide bolt receiving passageway, and wherein said elongate cover member is flush with the upper wall of said elongate member when positioned to overlie the slide bolt receiving passageway.

7. A locking astragal according to claim 6 wherein said elongate cover member comprises an upper wall, and a pair of opposing sidewalls connected to and extending downwardly therefrom, said pair of opposing sidewalls comprising an outwardly protruding lock member adjacent a bottom portion thereof to engage the respective pair of opposing bottom walls of said opposing upper lip upper lip members and lock said elongate cover member when positioned to overlie the slide bolt receiving passageway; wherein said elongate cover member comprises a lower elongate cover member extending from a bottom portion of said lower stiffener to a bottom portion of said lower slide bolt movement member, and an upper elongate cover member extending from an upper portion of said upper stiffener to an upper portion of said upper slide bolt movement member; and wherein said upper and lower stiffeners further comprise a channel for receiving said elongate cover member, said channel being defined as a space between said respective opposing sidewalls and said respective opposing guide members.

8. A locking astragal according to claim 1 wherein said elongate member further comprises at least one integrally formed screw boss strike adjacent a medial portion thereof; and further comprising at least one strike plate removably connected to the screw boss strike.

9. A locking astragal according to claim 1 wherein said elongate member has at least one lateral passageway adjacent an upper portion thereof and at least one lateral passageway adjacent a lower portion thereof, each of the respective at least one lateral passageways being aligned with at least one respective lateral passageway formed through each of said upper and lower stiffeners so that said respective at least one fasteners mount said respective upper and lower stiffeners to said elongate member and said elongate member to a door.

10. A lock member that pivotally engages a slide bolt movement member connected to a slide bolt of a locking astragal and that is moveable between locked and unlocked positions, the locking astragal including a plurality of fasteners positioned to extend through fastener receiving passageways formed through an elongate member of the locking astragal, the plurality of fasteners each having a top that protrudes above an upper portion of a bottom wall of the elongate member, the lock member comprising:

a user engagement portion that is substantially flat and adapted to be flush with an outer surface portion of the slide bolt movement member when the lock member is in the locked position and the unlocked position; and a lock portion opposite the user engagement portion, the lock portion having an unlocked side that is substantially flat and a locked side having an arcuate shape;

wherein the arcuate shaped lock side is positioned adjacent an interior portion of the slide bolt movement member when the lock member is in the locked position to abuttingly contact one of the plurality of fasteners to maintain the slide bolt in a locked position when the lock member is in the locked position; and wherein the substantially flat unlocked side is positioned adjacent the interior portion of the slide bolt movement member when the lock member is in the unlocked position.

11. A lock member according to claim 10 wherein said user engagement portion and said lock portion are integrally formed as a monolithic unit.

12. A lock member according to claim 11 wherein the arcuate shaped locked side of said lock portion is defined by a semi-circular shape.

13. A lock member according to claim 10 wherein the substantially flat unlocked side of said lock portion is moveable over the plurality of fasteners when the lock member is in the unlocked position.

14. A method of maintaining a locking astragal in a locked position when a slide bolt of the locking astragal is in a locked position, the locking astragal comprising a plurality of fasteners positioned to extend through fastener receiving passageways formed through an elongate member of the locking astragal, the plurality of fasteners each having a top that protrudes above an upper portion of a bottom wall of the elongate member, the method comprising;

moving a lock member that pivotally engages a slide bolt movement member from an unlocked position to a locked position, the slide bolt movement member being connected to the slide bolt of the locking astragal to move the slide bolt between the locked position and an unlocked position, the lock member comprising a user engagement portion that is substantially flat and adapted to be flush with an outer surface portion of the slide bolt movement member when the lock member is in the locked position and the unlocked position, and a lock portion opposite the user engagement portion, the lock portion having an unlocked side that is substantially flat and a locked side having an arcuate shape so that when the lock member is in the locked position, the arcuate shaped lock side is positioned adjacent an interior portion of the slide bolt movement member, and when the lock member is in the unlocked position, the flat side is positioned adjacent the interior portion of the slide bolt movement member;

abuttingly contacting the lock portion with one of the plurality of fasteners to maintain the slide bolt in the locked position when the lock member is in the locked position; and moving the substantially flat unlocked side of the lock portion over the fasteners when the lock member is in the unlocked position.

15. A method according to claim 14 wherein the user engagement portion and the lock portion are integrally formed as a monolithic unit; and wherein the arcuate shaped locked side of the lock portion is defined by a semi-circular shape.

* * * * *